US008220303B2

(12) United States Patent
Beuter et al.

(10) Patent No.: US 8,220,303 B2
(45) Date of Patent: Jul. 17, 2012

(54) APPARATUS FOR WINDING AND UNWINDING ROLLED STRIP

(75) Inventors: Matthias Beuter, Bad Berleburg (DE); Bernhard Ehls, Hilchenbach (DE)

(73) Assignee: SMS Siemag Aktiengesellschaft, Dusseldorf (DE)

( * ) Notice: Subject to any disclaimer, the term of this patent is extended or adjusted under 35 U.S.C. 154(b) by 353 days.

(21) Appl. No.: 12/223,951

(22) PCT Filed: Dec. 19, 2006

(86) PCT No.: PCT/EP2006/012206

§ 371 (c)(1), (2), (4) Date: Aug. 13, 2008

(87) PCT Pub. No.: WO2007/093210

PCT Pub. Date: Aug. 23, 2007

(65) Prior Publication Data

US 2009/0032634 A1 Feb. 5, 2009

(30) Foreign Application Priority Data

Feb. 15, 2006 (DE) ..... 10 2006 007 408

(51) Int. Cl.
*B21C 47/24* (2006.01)
*B21C 47/00* (2006.01)

(52) U.S. Cl. ..... 72/146; 242/553.2

(58) Field of Classification Search ..... 72/146, 72/148, 250; 242/520, 532, 533.2, 533.3, 242/535.1, 558, 559
See application file for complete search history.

(56) References Cited

U.S. PATENT DOCUMENTS 2,221,354 A * 11/1940 Linn ..... 72/146
4,005,830 A * 2/1977 Smith ..... 242/533.3
4,019,359 A * 4/1977 Smith ..... 72/231

FOREIGN PATENT DOCUMENTS

| | | | |
|---|---|---|---|
| DE | 198 03 091 | | 7/1999 |
| EP | 0 933 147 | | 8/1999 |
| JP | 10034231 | A * | 2/1998 |
| JP | 2000 158041 | | 6/2000 |
| WO | 03/013753 | | 2/2003 |

* cited by examiner

*Primary Examiner* — Debra Sullivan
(74) *Attorney, Agent, or Firm* — Lucas & Mercanti, LLP; Klaus P. Stoffel

(57) ABSTRACT

The invention relates to an apparatus for winding and unwinding rolled strip (WB) discharging from a mill train (WS), in which apparatus the rolled strip (WB) discharging from the mill train (WS) is introduced by a set of bending rolls (BR) into a winding chamber (WK) having a rotationally driven roller pair (RP) and is wound into a coil (WB), and the coil is then put onto a roller table (GR) and unwound from these rollers with the direction of rotation being reversed and the start of the strip is fed to a driver device (RT). The apparatus is improved by a supporting slide (TS) which can be pushed into the winding chamber (WK) and in whose side walls a pivoted lever (SH) is mounted, the free end of which carries a pressure roller (AR) which can be put onto the rolled strip coil and pushes the latter out of the winding chamber (WK) onto the adjoining roller table (GR).

1 Claim, 2 Drawing Sheets

APPARATUS FOR WINDING AND UNWINDING ROLLED STRIP

BACKGROUND OF THE INVENTION

The invention concerns a device for coiling and uncoiling rolled strip, in which the strip emerging from the rolling train is picked up by a set of bending rolls, moved into a coiling chamber that has rotationally driven rollers, and coiled into a coil. The coil is later placed on a roller table and uncoiled by reversing the direction of rotation of the rollers of the roller table, and the leading end of the strip is then fed to a driving device.

In a previously known device of this type disclosed by WO 03/013753, the strip initially bent by the bending rolls is fed to a coiling chamber that has several driven rollers, and, after the strip has been coiled into a coil, the support rollers are all brought into the plane of the roller table and in this position allow further conveyance of the coiled coil out of the coiling station to a downstream support device that has driven rollers. This support device can be displaced in the direction of strip conveyance and makes it possible to uncoil the coil resting on it by reversal of the direction of rotation of its rollers with subsequent insertion of the leading end of the strip into a downstream driving device. Another published patent (EP 933 147) provides for two pairs of support rollers, which are arranged in succession for supporting the coiled coil, are supported in tiltable frames that can be moved towards and away from each other, and allow each coiled coil to be moved from the coiling station to an uncoiling station.

In these devices, problems are encountered with the conveyance of the coil from the supporting support rollers of the coiling chamber to the rollers of the downstream conveyance system, because this conveyance begins with the coil at a standstill in the coiling chamber, and because the coil begins with not only the conveyance movement but additionally with the uncoiling rotation.

SUMMARY OF THE INVENTION

Therefore, the invention proposes to push the coil out of the coiling chamber onto a roller table segment downstream of the coiling chamber, where the plane of conveyance of the roller table segment can be angularly adjusted to the plane of support of the coiling chamber. In accordance with the invention, this displacement of the coil is produced by a pivoted lever, which is mounted in the side walls of a support carriage that can be moved into the coiling chamber and carries a contact roll at its free end. This contact roll rests on the circumference of the coil and, when the pivoted lever is swiveled, pushes the coil out of the coiling chamber onto the downstream roller table segment. Then, after the next coil has been moved into the coiling chamber, the pivoted lever is swiveled back to its initial position, and the contact roll is placed on the coil.

The invention will now be explained in greater detail with reference to the specific embodiment illustrated in the drawings.

DETAILED DESCRIPTION OF THE INVENTION

The rolled strip is brought out of the rolling train WS and introduced into the coiling chamber WK via a system of bending rolls BR. In the coiling chamber WK, the rolled strip is rolled into a coil resting on a pair of rollers RP with a slightly inclined roller plane. This pair of rollers RP is followed by a group roller table, whose roller plane R runs with a slight, opposite inclination from the rollers of the coiling chamber WK and can be adjusted in its inclination by a servomotor SM. A straightening driver system RT is arranged downstream of this group roller table GR.

Figure 1:
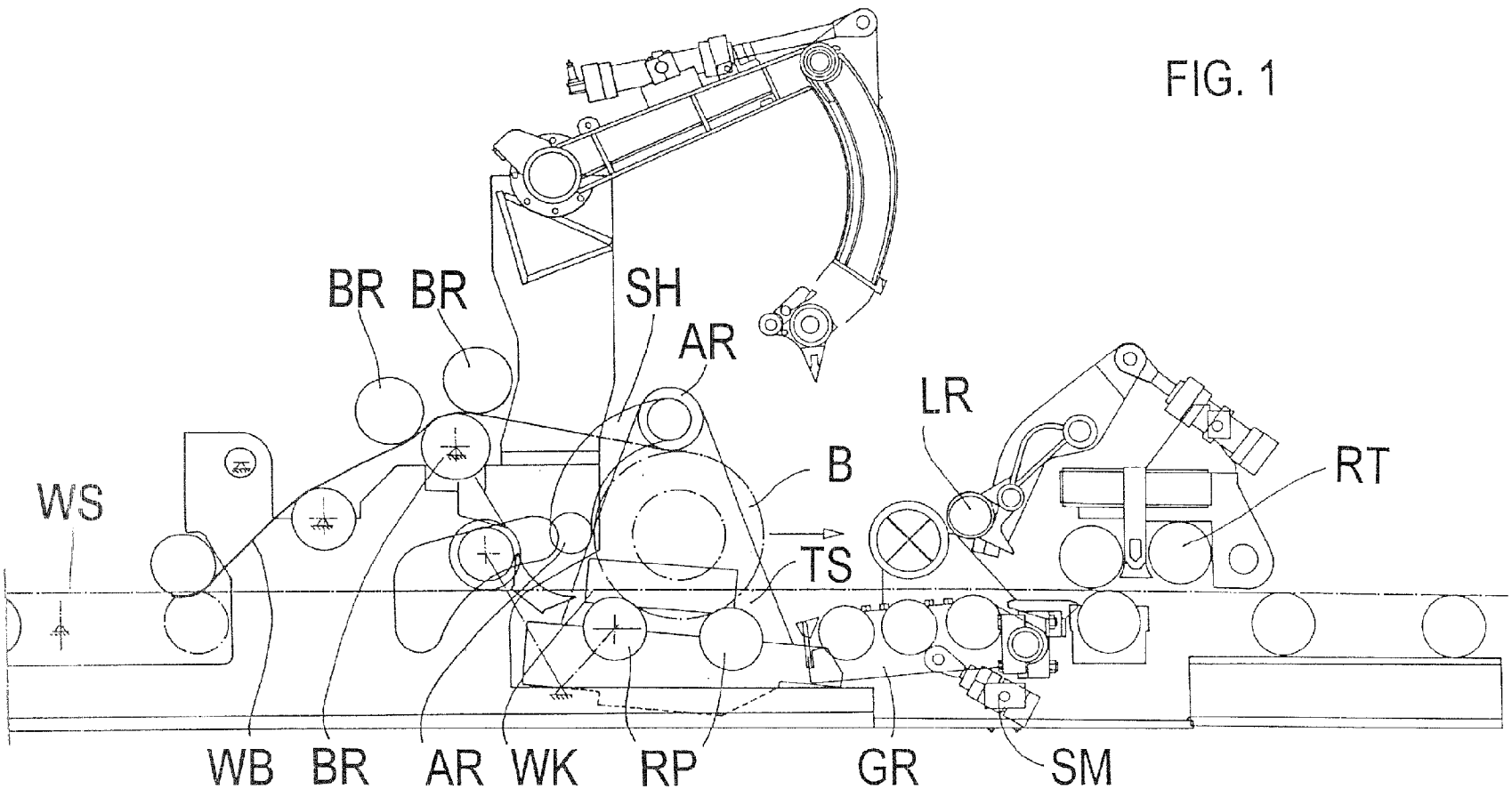
FIG. 1 shows a schematic side view of the device.
Figure 2:
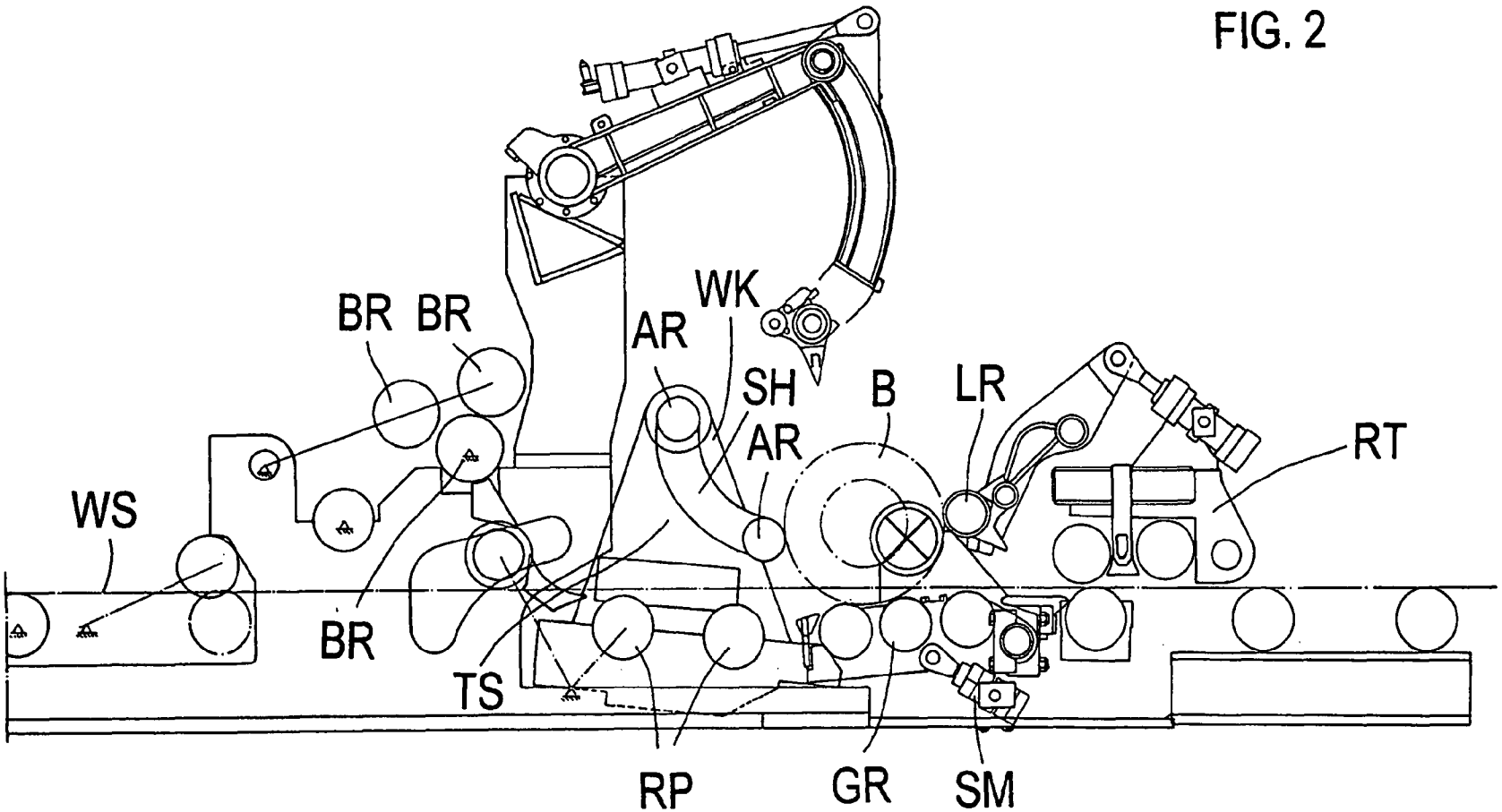
FIG. 2 shows the device according to FIG. 1 in a different position.

A support carriage TS can be moved into the coiling chamber WK. A pivoted lever SH is pivoted in the side walls of the support carriage TS above the coil B of rolled strip WB. The pivoted lever SH carries a contact roll AR at its free end, and the contact roll AR can be laid on the circumference of the coil B. As is apparent from FIG. 1 in conjunction with FIG. 2, the coil B, which has been coiled in the coiling chamber WK, is pushed out of the coiling chamber WK and onto the group roller table GR by the pivoted lever SH and the contact roll AR it carries, and, resting on the group roller table GR, the coil B is fed to the straightening driver RT by means of the guide roll LR mounted on the straightening driver RT.

LIST OF REFERENCE LETTERS

WB rolled strip
WS rolling train
WK coiling chamber
BR bending rolls
B coil
RP pair of rollers
SM servomotor
RT straightening driver
TS support carriage
SH pivoted lever
AR contact roll
RG roller table
GR group roller table
LR guide roll

The invention claimed is:

1. Device for coiling and uncoiling rolled strip (WB) discharged from a rolling train (WS), in which the rolled strip (WB) emerging from the rolling train (WS) is picked up by a set of bending rolls (BR), moved into a coiling chamber (WK) that has rotationally driven pairs of rollers (RP), and coiled into a coil, where the coil is later placed on a roller table (CR) and uncoiled by reversing the direction of rotation of rollers of the roller table, and a leading end of the strip (WB) is then fed to a driving device (RT), wherein a support carriage (TS) can be moved into the coiling chamber (WK), a pivoted lever (SH) is supported in side walls of the support carriage (TS), and a contact roll (AR), which is supported on a free end of the pivoted lever (SH), can be placed on the coil of rolled strip, and pushes the coil of rolled strip out of the coiling chamber (WK) and onto the roller table (GR) that follows the coiling chamber (WK), the rollers (RP) of the coiling chamber (WK) having a fixed inclined roller plane and the roller table (GR) having a roller plane inclined opposite to the roller plane of the coiling chamber (WK).

* * * * *